US008438690B2

(12) United States Patent
Tanaka et al.

(10) Patent No.: US 8,438,690 B2
(45) Date of Patent: May 14, 2013

(54) CLEANING TOOL AND CLEANING ELEMENT HOLDER

(75) Inventors: Yoshinori Tanaka, Kagawa-ken (JP); Masumi Fukuzawa, Kagawa-ken (JP); Masaho Hayashi, Tokyo (JP); Jun Uragami, Fukuoka-ken (JP)

(73) Assignee: Uni-Charm Corporation, Ehime-Ken (JP)

( * ) Notice: Subject to any disclaimer, the term of this patent is extended or adjusted under 35 U.S.C. 154(b) by 0 days.

(21) Appl. No.: 12/991,915

(22) PCT Filed: May 14, 2009

(86) PCT No.: PCT/JP2009/002126

§ 371 (c)(1),
(2), (4) Date: May 9, 2011

(87) PCT Pub. No.: WO2009/139175

PCT Pub. Date: Nov. 19, 2009

(65) Prior Publication Data

US 2011/0203068 A1 Aug. 25, 2011

(30) Foreign Application Priority Data

May 15, 2008 (JP) ..... 2008-128877

(51) Int. Cl.
*A47L 25/00* (2006.01)

(52) U.S. Cl.
USPC ..... 15/209.1; 15/145; 15/229.4; 15/231

(58) Field of Classification Search ..... 15/231, 15/209.1, 145; *A47L 25/00*
See application file for complete search history.

(56) References Cited

U.S. PATENT DOCUMENTS 5,953,784 A * 9/1999 Suzuki et al. ..... 15/209.1

FOREIGN PATENT DOCUMENTS

JP 09154791 A 6/1997
JP 10323311 A 12/1998
JP 2007167425 A 7/2007

OTHER PUBLICATIONS

International Search Report for PCT/JP2009/002126 mailed Jun. 9, 2009.
Extended European Search Report for Application No. 09746382.2 mailed Nov. 14, 2012.

* cited by examiner

*Primary Examiner* — Monica Carter
*Assistant Examiner* — Stephanie N Berry
(74) *Attorney, Agent, or Firm* — Lowe Hauptman Ham & Berner, LLP

(57) ABSTRACT

It is an object of the invention to provide an elongate cleaning element holder which contributes to a smoother cleaning operation, for a cleaning tool in which a cleaning element for cleaning an object to be cleaned is attached to the cleaning element holder. The representative cleaning element holder 120 includes a holding element 132 to be inserted into an insert region of the cleaning element. The holding element 132 has an inclined part 136 wherein a height of the inclined part 136 in a direction transverse to an extending direction of the holding element 132 gradually increases toward the connection.

20 Claims, 7 Drawing Sheets

CLEANING TOOL AND CLEANING ELEMENT HOLDER

RELATED APPLICATIONS

The present application is a national phase of PCT/JP2009/002126, filed May 14, 2009 and is based on, and claims priority from, Japanese Application Number 2008-128877, filed May 15, 2008.

BACKGROUND OF THE INVENTION

1. Field of the Invention

The invention relates to a cleaning tool, and more particularly to a cleaning tool having a cleaning element for use in cleaning an object.

2. Description of the Related Art

Japanese non-examined laid-open Patent Publication No. 9-154791 discloses a cleaning tool having a cleaning cloth and a holder that detachably holds the cleaning cloth inserted into a holding region of the cleaning cloth. This cleaning tool is capable of wiping an object to be cleaned. However, in designing a cleaning tool of this type in which a holder-side holding element is inserted into an insert region of a cleaning element and thereby holds the cleaning element, it is required to provide an effective technique for realizing a smoother cleaning operation.

SUMMARY OF THE INVENTION

Accordingly, it is an object of the invention to provide an elongate cleaning element holder which contributes to a smoother cleaning operation for a cleaning tool in which a cleaning element for cleaning an object is attached to the cleaning element holder.

The above-described object can be achieved by the claimed invention. This invention can be applied to the construction of cleaning tools for cleaning regions to be cleaned (floors, walls, ceilings, external walls, pillars, furniture, clothes, curtains, bedding, lighting, electric cords, home electric appliances, etc.) inside and outside of houses, apartments, buildings, factories, vehicles, etc. or regions of human body parts to be cleaned. These regions to be cleaned may be either flat or curved, uneven or stepped.

A cleaning tool according to the invention is used for cleaning a region to be cleaned and includes at least a cleaning element holder and a cleaning element. The cleaning element holder is an elongate member. The cleaning element holder has a grip to be held by a user and a holding element extending in a longitudinal direction from a connection which is connected to the grip. The grip and the holding element may be formed integrally or separately with respect to each other. The holding element is designed to be inserted into an insert region of the cleaning element to thereby hold the cleaning element. One or more holding elements can be provided as necessary. Particularly, the holding element has an inclined part which is inclined such that a height of the inclined part in a direction transverse to an extending direction of the holding element gradually increases from the tip end which is first inserted into the insert region, toward the connection. This is, in other words, the holding element has an inclined part which is inclined such that the height (or thickness) of the holding element is increasingly changed from the tip end to the connection with respect to the extending direction of the holding element. In regard to this construction, the inclined part can form the entirety or part of the holding element. Further, the increase or decrease of the height of the inclined part includes increases or decreases in linear, curved and stepped forms. Further, the "height of the inclined part in a direction transverse to an extending direction of the holding element" is typically defined as the height in the vertical direction of the holding element in normal cleaning conditions.

With such a construction of the cleaning tool according to this invention, the flexibility of the holding element increases from the connection side toward the tip end side, so that the flexibility of the holding element can be ensured. Moreover, the holding element has an increasingly higher rigidity or strength from the tip end side toward the connection side of the holding element. Thus, an area of the holding element on the connection side can be reinforced, so that a smoother cleaning operation can be realized.

Further, in the cleaning tool according to the invention, the cleaning element may be of disposable type designed for single use, disposable type designed for multiple use which can be used several times, while holding dust which has been removed from the region to be cleaned, on a brush portion, or reusable type which can be reused by washing.

In a further aspect of the invention, the inclined part may preferably be contiguous to the connection, and the height of the inclined part in a direction transverse to the extending direction of the holding element peaks at an area of the inclined part which is contiguous to the connection. With such a construction, in the holding element, particularly, the connection and the area contiguous to the connection can be reinforced.

In a further aspect of the invention, the grip and the holding element may preferably be separately formed, and at the connection, a first connection on the side of the holding element and a second connection on the side of the grip can be engaged with each other. Further, as viewed in section in a direction transverse to the extending direction of the holding plate, preferably, the first connection includes a bottom plate part extending along the holding element, an upright part extending upward from both edges of the bottom plate part, an upper plate part extending between the upright pails above the bottom plate part, a demarcated region demarcated by the bottom plate part, the upright parts and the upper plate part, and an opening that is formed in the upper plate part, and provides communication between the demarcated region and an upper region above the upper plate part. Further, preferably, the second connection includes an insertion part which is inserted and engaged in the demarcated region, and a contiguous part that is contiguously formed on an upper side of the insertion part and has a smaller width than an opening width of the opening, and in the state in which the insertion part is inserted and engaged in the demarcated region, the contiguous part is exposed to the upper region through the opening. With such a construction, the first connection and the second connection can be prevented from being reversed during connection to each other. Specifically, even if an attempt is made to insert the insertion part of the second connection which is reversed with respect lo the first connection into the demarcated region of the first connection, the insertion part cannot be inserted into the demarcated region due to interference of the contiguous part contiguous to the insertion part. Thus, the first connection and the second connection can be prevented from being connected improperly.

In a further aspect of the invention, an engagement protrusion may preferably be formed on one of opposed sides of the bottom plate part and the insertion part, and an engagement hole is formed on the other side, and the grip and the holding element are locked with respect to each other by engagement of the engagement protrusion and the engagement hole. With such a construction, the engagement protrusion and the engagement hole become invisible from the outside and thus the outward appearance is enhanced. Moreover, the engagement protrusion and the engagement hole are protected from dust or dirt, so that a stable operation of connecting the first connection and the second connection can be ensured.

In a further aspect of the invention, a plurality of holding elements may preferably extend from the connection in parallel in the longitudinal direction. In order to extend in "parallel" here, a plurality of the holding elements may be required to be disposed at least side by side. Such a manner of extending in parallel here includes the manner in which a plurality of the holding elements are disposed in parallel, and the manner in which the distance between two adjacent holding elements decreases toward the front end. With such a construction, in each of the holding elements of the cleaning element holder, not only the flexibility of the holding element can be ensured, but an area of the holding element toward the proximal end side can be reinforced.

Further, a cleaning element holder according to the invention is an elongate cleaning element holder to which a cleaning element for use in cleaning an object to be cleaned is attached, and has substantially the same construction as the cleaning element holder of the above-described cleaning tool. Therefore, with the cleaning element holder according to this invention, in one or more holding elements of the cleaning element holder, not only the flexibility of the holding element can be ensured, but an area of the holding element toward the connection side can be reinforced. Further, with the cleaning element holder according to this invention, in the holding element, particularly, the connection and an area contiguous to the connection can be reinforced. Further, with the cleaning element holder according to this invention, the first connection and the second connection can be prevented from being connected improperly. Further, with the cleaning element holder according to this invention, the engagement protrusion and the engagement hole become invisible from the outside and thus the outward appearance is enhanced. Moreover, the engagement protrusion and the engagement hole are protected from dust or dirt, so that a stable operation of connecting the first connection and the second connection can be ensured.

EFFECT OF THE INVENTION

As described above, according to the invention, an elongate cleaning element holder which contributes to a smoother cleaning operation can be provided for a cleaning tool in which a cleaning element for cleaning an object to be cleaned is attached to the cleaning element holder.

DETAILED DESCRIPTION OF THE INVENTION

A cleaning tool 100 as a representative embodiment of a cleaning tool according to the invention is now described with reference to the drawings. Objects to be cleaned with the cleaning tool 100 include regions to be cleaned (floors, walls, windows, ceilings, external walls, furniture, clothes, curtains, bedding, lighting, home electric appliances, etc.) inside and outside of houses, apartments, buildings, factories, vehicles, etc. and regions of human body parts to be cleaned. These regions to be cleaned may be either flat or curved, uneven or stepped.

FIG. 1 shows the cleaning tool 100 according to this embodiment in perspective view, in a state disassembled into a cleaning element 110 and a cleaning element holder 120. As shown in FIG. 1, the cleaning tool 100 comprises the cleaning element 110 and the cleaning element holder 120.

The cleaning element 110 has a function of wiping, sweeping or scraping dirt on the region to be cleaned. The cleaning element 110 is in a sheet-like or plate-like form at the time of purchase or in the initial unused state, and in use, it is loosened such that its volume is increased. As shown in FIG. 1, the cleaning element 110 has a rectangular shape in plan view, extending in a predetermined longitudinal direction (the direction of the length), which is explained in more detail below. The cleaning element 110 includes a cleaning element body 111 and a holding sheet 112 stacked and fusion bonded together at a fusion bonded part 113, 114. The fusion bonded parts 113, 114 may be designed to extend continuously or discontinuously. Further, the extending length of the fusion bonded part 113, 114 can be appropriately selected as necessary.

A pair of right and left spaces demarcated by the fusion bonded parts 113, 114 form insert regions 115 into which holding portions (holding plates 132 of a holder body 130 which is described below) of the cleaning element holder 120 are inserted. The insert regions 115 are configured to have adequate size (insertion width and insertion depth) to receive the holding plates 132 of the holder body 130. Further, each of the fusion bonded parts 114 is arranged to have such a bond width that the insertion width of each of the insert regions 115 is larger at the both ends than at the central portion. The cleaning element 110 is a feature that corresponds to the "cleaning element" according to this invention. The cleaning element 110 may also have a square or other shape in plan view as necessary. Further, the insert regions 115 are the features that correspond to the "insert region" according to this invention. Each of the insert regions 115 may be formed by a single insert portion extending elongate or by a plurality of insert portions extending discontinuously.

The cleaning element holder 120 is removably attached to the cleaning element 110. The cleaning element holder 120 is an elongate member including the holder body 130 and the handle 140 connected to each other. The cleaning element holder 120 is a feature that corresponds to the "cleaning element holder" according to this invention. The handle 140 includes a handle body 141 extending in an elongate form and a handle body-side connection 142 disposed between the handle body 141 and the holder body 130. The handle body 141 is an area to be held by a user. The handle body-side connection 142 is an area on the handle body 141 side at which the handle body 141 and the holder body 130 are fixedly connected to each other. The handle 140 or the handle body 141 here forms the "grip" according to this invention.

The holder body 130 has a function of detachably holding the cleaning element 110. The holder body 130 includes a holder body-side connection 131 between the holder body 130 and the handle body 141, a pair of right and left holding plates 132 and a retaining plate 134. The holding plates 132 extend forward in the longitudinal direction from the holder body-side connection 131 and parallel with a predetermined spacing therebetween on the same plane. In other words, the holder body 130 has a bifurcated form. Each of the holding plates 132 has a constant width in the longitudinal direction or is tapered. The holding plates 132 here form the "holding elements" according to this invention. Further, the holder body-side connection 131 here forms the "connection" according to this invention. The holding plates 132 may also have a rod-like shape having a circular or polygonal section.

Further, two projections 133 are formed toward the front and the rear on the outer edge of each of the holding plates 132. Each of the projections 133 has an elliptic contour projecting outward from the holding plate 132 and has a convexly curved projecting surface. Further, an opening or hollow portion 133*a* is formed in the central portion of the projection 133 in order to increase elasticity. The retaining plate 134 extends forward between the pair holding plates 132 and is convexly curved downward. The retaining plate 134 further has an engagement lug (not shown) on the underside.

The holding plates 132 can be inserted into the associated insert regions 115 formed in the cleaning element 110 and have a function of holding the cleaning element 110 in the inserted state. In the inserted state, the holding plates 132 are fitted in the associated insert regions 115 by close sliding contact, so that the holding plates 132 are securely attached to the cleaning element 110. Further, in each of the insert regions 115, as described above, the insertion width of the both ends is larger than that of the central portion, and in the inserted state, the front and rear projections 133 of each of the holding plates 132 are placed in the wider areas on the both sides of the narrower area of the associated insert region 115. Thus, in this arrangement, the holding plates 132 serve to prevent the cleaning element 110 from coming off. Further, in the inserted state, the retaining plate 134 presses the cleaning element 110 from above, and the engagement lug (not shown) formed on the underside of the retaining plate 134 serves as a stopper for preventing the cleaning element 110 from coming off. Thus, in the inserted state in which the holding plates 132 are inserted into the insert regions 115 of the cleaning element 110, the cleaning element 110 is reliably retained by the holder body 130.

The structure of the holding plates 132 is further explained in more detail with reference to FIGS. 2 to 8. FIG. 2 is a side view of the holding plate 132 of the holder body 130 in this embodiment, and FIG. 3 is a plan view of the holder body 130 in this embodiment and its vicinity. FIG. 4 is a sectional view of the holding plate 132 which is taken along line A-A in FIG. 3. FIG. 5 is a sectional view of the holder body-side connection 131 and the handle body-side connection 142 which is taken along line B-B in FIG. 3. FIG. 6 is a plan view of the holder body 130 in this embodiment and its vicinity, showing the construction of the holder body-side connection 131 and the handle body-side connection 142. Further, FIG. 7 is a sectional view showing the structure of engagement between an engagement protrusion 138 on the holder body-side connection 131 side and an engagement hole 143 on the handle body-side connection 142 side which are shown in FIG. 6, in a yet-to-be engaged state. FIG. 8 is a sectional view showing the structure of engagement between the engagement protrusion 138 on the holder body-side connection 131 side and the engagement hole 143 on the handle body-side connection 142 side which are shown in FIG. 6, in an engaged state.

As shown in FIGS. 2 and 3, each of the holding plates 132 has an inclined part 136 on a holding plate upper surface 135. The inclined part 136 is inclined such that its height in a direction transverse to the extending direction of the holding plate 132 (height H in FIG. 2) gradually increases from a tip end side (on the left as viewed in FIGS. 2 and 3) which is first inserted into the associated insert region 115, toward a connection side (on the right as viewed in FIGS. 2 and 3). The "height in a direction transverse to the extending direction of the holding plate 132" is typically defined as the height in the vertical direction of the holding plate 132 in normal cleaning conditions. Particularly, the connection side of the inclined part 136 is contiguous to the holder body-side connection 131, and the height H of the inclined part 136 peaks at this contiguous area. Further, the lateral width (width D1 in FIG. 3) of the inclined part 136 gradually increases from the tip end side (on the left as viewed in FIGS. 2 and 3) toward the connection side (on the right as viewed in FIGS. 2 and 3) and peaks at the area contiguous to the holder body-side connection 131. Specifically, in this embodiment, the height H of the inclined part 136 is gradually reduced, or the inclined part 136 is gradually thinned, toward the tip end side of the holding plate 132. The inclined part 136 may be provided entirely on the holding plate 132 with respect to the extending direction of the holding pate 132. Otherwise, the inclined part 136 may be provided in part on the holding plate 132 with respect to the extending direction of the holding plate 132. Moreover, the width D1 of the inclined part 136 is gradually reduced, or the inclined part 136 is gradually narrowed, toward the tip end side of the holding plate 132. The inclined part 136 here is a feature that corresponds to the "inclined part" according to this invention.

With such a construction, the holding plate 132 has an increasingly higher flexibility toward the tip end side, so that the flexibility of the holding plate 132 can be ensured. Moreover, the holding plate 132 has an increasingly higher rigidity or strength toward the proximal end side. Therefore, the holder body-side connection 131 and an area contiguous to the holder body-side connection 131 can be reinforced, and the holder body-side connection 131 and the handle body-side connection 142 can be connected with stability. As a result a smoother cleaning operation can be realized. Further, the height H and the width D1 of the inclined part 136 of the holding plate 136 may not only be designed to increase or decrease in a linear form, but may be designed to increase or decrease in a curved or stepped form. Further, the inclined part 136 may be designed not to be contiguous to the holder body-side connection 131, as necessary. For example, the inclined part 136 may be terminated before the holder body-side connection 131.

Further, as shown in FIG. 4, a holder plate lower surface 137 of the holder plate 132 has a thin-walled part 137*a* which is bulged upward corresponding to the inclined part 136. With this construction, the holder plate 132 can be reduced in weight. The thin-walled part 137*a* can be appropriately omitted as necessary.

Further, in this embodiment, as for the structure of the cleaning element holder 120, the holder body 130 and the handle 140 are separately formed and designed to be assembled together. Instead of this structure, however, the cleaning element holder 120 may have any other appropriately selected structure, such as a structure in which the holder body 130 and the handle 140 are molded in one piece.

As for the separate structure of the holder body 130 and the handle 140, as shown in FIG. 6, the holder body-side connection 131 on the holder body 130 side and the handle body-side connection 142 on the handle body 141 side can be engaged with each other at the connection between the handle body 141 and the holder body 130. The holder body-side connection 131 and the handle body-side connection 142 are features that correspond to the "first connection" and the "second connection", respectively, according to this invention. Further, the holder body-side connection 131 and the handle body-side connection 142 are locked with respect to each other by engagement of the engagement protrusion 138 formed on the upper surface of the holder body-side connection 131 and the engagement hole 143 formed in the lower surface of the handle body-side connection 142, which is described below in more detail. Further, a guide hole 144 for guiding the engagement protrusion 138 to the engagement hole 143 is formed in the lower surface of the handle body-side connection 142 on the tip end side (on the left as viewed in FIG. 6) forward of the engagement hole 143.

As shown in FIG. 5, as viewed in section in a direction transverse to the extending direction of the holding plate 132, the holder body-side connection 131 includes at least a bottom plate part 131*a*, upright parts 131*b*, an upper plate part 131*c*, a demarcated region 131*d* and an opening 131*e*. The bottom plate part 131*a* extends along the holding plates 132. The upright parts 131*b* extend upward from the both edges of the bottom plate part 131*a*. The upper plate part 131*c* extends between the upright parts 131*b* above the bottom plate part 131*a*. The demarcated region 131*d* is defined as a space demarcated by the bottom plate part 131*a*, the upright parts 131*b* and the upper plate part 131*c*, so that a structure ("box structure" or "pocket structure") that envelops an insert (insertion part 142*a*) from at least three directions and holds it with stability is formed. The opening 131*e* is formed in the upper plate part 131*c* and provides communication between the demarcated region 131*d* and an upper region 150 above the upper plate part 131*c*, or a region outside the demarcated region 131*d*. The bottom plate part 131*a*, the upright part 131*b*, the upper plate part 131*c*, the demarcated region 131*d*, the opening 131*e* and the upper region 150 are features that correspond to the "bottom plate part", the "upright part", the "upper plate part", the "demarcated region", the "opening" and the "upper region", respectively, according to this invention.

Further, as shown in FIG. 5, the handle body-side connection 142 includes at least the insertion part 142*a* and a contiguous part 142*b*. The insertion part 142*a* is a flange part extending outward from the contiguous part 142*b* on the lower side of the handle body-side connection 142 and designed as an insert which is inserted and engaged in the demarcated region 131*d* of the holder body-side connection 131. The contiguous part 142*b* is contiguously formed on the upper side of the insertion part 142*a* and has a smaller width D2 than an opening width D3 of the opening 131*e*. With this construction, in the state in which the insertion part 142*a* is inserted and engaged in the demarcated region 131*d*, the contiguous part 142*b* is exposed to the upper region 150 through the opening 131*e*. The insertion part 142*a* and the contiguous part 142*b* are features that correspond to the "insertion part" and the "contiguous part", respectively, according to this invention. Further, the insertion part 142*a* and the contiguous part 142*b* may be formed integrally or separately with respect to each other.

With such a construction, the holder body-side connection 131 and the handle body-side connection 142 can be prevented from being reversed during connection to each other. Specifically, even if an attempt is made to insert the insertion part 142*a* of the handle body-side connection 142 which is reversed with respect to the holder body-side connection 131, into the demarcated region 131*d* of the holder body-side connection 131, the insertion part 142*a* cannot be inserted into the demarcated region 131*d* due to interference of the contiguous part 142*b* contiguous to the insertion part 142*a*. Thus, the holder body-side connection 131 and the handle body-side connection 142 can be prevented from being connected improperly. Further, in this embodiment, the bottom plate part 131*a* is described as not having an opening, but it may be provided with an opening having an opening width smaller than the width of the contiguous part 142*b*. With such an opening, the effect of preventing the holder body-side connection 131 and the handle body-side connection 142 from being connected improperly can also be obtained.

Engagement of the engagement protrusion 138 of the holder body-side connection 131 and the engagement hole 143 of the handle body-side connection 142 is now explained. When the insertion part 142*a* of the handle body-side connection 142 is inserted into the demarcated region 131*d*, the insertion part 142*a* and the bottom plate part 131*a* are allowed to slide in respective directions of arrows in FIG. 7 while being prevented from moving in the vertical directions. At this time, the insertion part 142*a* is slid along the upper surface of the bottom plate part 131*a*, so that the insertion part 142*a* can be smoothly inserted into the demarcated region 131*d*. Thus, the stability of connection between the holder body-side connection 131 and the handle body-side connection 142 can be provided. Further, in this embodiment, the engagement protrusion 138 has an engagement protrusion inclined part 138*a*, and the guide hole 144 has an end having a guide hole inclined part 144*a* which is configured to substantially conform to the inclination of the engagement protrusion inclined part 138*a*. Therefore, in the above-described sliding process, the engagement protrusion 138 is guided to the end of the guide hole 144 and then the guide hole inclined part 144*a* runs onto the engagement protrusion inclined part 138*a*. Finally, the engagement protrusion 138 is engaged in the engagement hole 143. Thus, the holder body-side connection 131 and the handle body-side connection 142 are locked with respect to each other and connection between the holder body 130 and the handle 140 is completed.

In the state of engagement in which the engagement protrusion 138 is engaged in the engagement hole 143, an engagement protrusion upright part 138*b* and an engagement hole upright part 143*a* abut against each other in surface contact in a direction of disengagement. Thus, the holder body 130 and the handle 140 are prevented from being accidentally disconnected from each other. Further, in this construction, the engagement protrusion 138 and the engagement hole 143 are formed in an area which cannot be seen from the outside when the holder body 130 and the handle 140 are engaged with each other. Specifically, the engagement protrusion 138 and the engagement hole 143 are formed on the opposed sides of the bottom plate part 131*a* and the insertion part 142*a*, or on the upper surface of the bottom plate part 131*a* and the lower surface of the insertion part 14, respectively. Therefore, the engagement protrusion 138 and the engagement hole 143 become invisible from the outside and thus the outward appearance is enhanced. Moreover, the engagement protrusion 138 and the engagement hole 143 are protected from dust or dirt, so that stable connecting operation can be ensured. The engagement protrusion 138 and the engagement hole 143 are features that correspond to the "engagement protrusion" and the "engagement hole", respectively, according to this invention. Further, the engagement hole 143 may be provided in the upper surface of the bottom plate part 131*a* and the engagement protrusion 138 may be provided on the lower surface of the insertion part 142*a*, as necessary.

Further, the handle body-side connection 142 and the holder body-side connection 131 may preferably be formed of different kinds of resins or resins of varying hardness, such as a combination of ABS (acrylonitrile-butadiene-stylene) resin and PP (polypropylene) resin, a combination of polyacetal resin and PE (polyethylene) resin, a combination of polycarbonate resin and PP (polypropylene) resin, and a combination of acrylic resin and PE (polyethylene) resin can be used. With such a construction, wear of the members that contact each other in the above-described sliding process can be reduced, and the guide hole inclined part 144*a* can smoothly run on the engagement protrusion inclined part 138*a*.

Referring to FIG. 9, the structure of the cleaning element 110 is specifically described. FIG. 9 is a perspective view of a layered part of the cleaning element 110 which is shown separated into component elements.

As shown in FIG. 9, in the cleaning element 110 of this embodiment, the holding sheet 112 is overlaid on the cleaning element body 111 on the cleaning side (which is also referred to as the "lower side" or the "back") shown on the upper side in FIG. 9. Further, the cleaning element body 111 has a cleaning side sheet 111*c*, a fiber assembly 111*b* and a base sheet 111*a* placed one on the other in this order from the cleaning side (lower side). In this case, the holding sheet 112 and the base sheet 111*a* are overlaid on the side of the fiber assembly 111*b* opposite the cleaning side sheet 111*c* (lower side sheet) and form an upper side sheet.

The base sheet 111*a*, the fiber assembly 111*b* and the cleaning side sheet 111*c* which form the cleaning element body 111 have the same rectangular sheet-like form in plan view and extend in a longitudinal direction of the cleaning element 110. The fiber assembly 111*b* and the cleaning side sheet 111*c* form a brush-like part having a dirt removing function, which is also referred to as the "brush part". The cleaning element 110 may be of disposable type designed for single use, disposable type designed for multiple use which can be used several times, while holding dust which has been removed from the region to be cleaned, on the brush part, or reusable type which can be reused by washing. Further, in this embodiment, the cleaning element body 111 of the cleaning element 110 is described as a structure having the base sheet 111*a*, the fiber assembly 111*b* and the cleaning side sheet 111*c* stacked in layer, but may be constructed as a structure having an additional fiber layer and/or sheet.

The holding sheet 112, the base sheet 111*a* and the cleaning side sheet 111*c* have a plurality of zigzag strips (strip portions) extending in a direction transverse to the longitudinal direction of the cleaning element 110. Specifically, the holding sheet 112 comprises a plurality of strips 112*a* arranged in parallel and extending in a direction transverse to the longitudinal direction of the cleaning element 110. The base sheet 111*a* comprises a plurality of strips 111*d* arranged in parallel and extending in a direction transverse to the longitudinal direction of the cleaning element 110. The cleaning side sheet 111*c* comprises a plurality of strips 111*e* arranged in parallel and extending in a direction transverse to the longitudinal direction of the cleaning element 110. An improved structure which can easily trap dust and thus has a higher cleaning function can be realized by the zigzag strips of the sheets. The strips may have the same kind or different kinds of shape appropriately selected from various shapes, such as zigzag, linear and curved shapes.

The construction of the nonwoven fabric forming the above-described base sheet 111*a*, cleaning side sheet 111*c* and holding sheet 112 and the construction of the fiber assembly 111*b* are now explained in detail.

(Construction of Nonwoven Fabric)

The base sheet 111*a*, the cleaning side sheet 111*c* and the holding sheet 112 can typically be formed of sheet-type nonwoven fabric comprising thermal melting fibers (thermoplastic fibers) and thus referred to as nonwoven fabric sheet. The nonwoven fabric has a sheet-like configuration formed by fixing or intertwining fibers by mechanical, chemical or heat treatment. The nonwoven fabric partly includes thermoplastic fibers and thus can be fusion bonded. Further, the nonwoven fabric has a plurality of strips. Examples of the thermal melting fibers (thermoplastic fibers) include polyethylene, polypropylene and polyethylene terephthalate. The nonwoven fabric may be manufactured by through-air bonding, spun bonding, thermal bonding, spun lacing, point bonding, melt blowing, stitch bonding, chemical bonding, needle punching or other similar processes. In order to enhance the dust wiping function, if is preferred to use a nonwoven fabric having higher rigidity. Further, as an alternative to or in addition to the nonwoven fabric, urethane, sponge, woven fabric, net, split cloth and other similar materials which are formed into strips may be used.

(Construction of Fiber Assembly)

The fiber assembly 111*b* is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 111*b* partially includes thermoplastic fibers and can be fusion bonded. The fibers forming the fiber assembly 111*b* are elements of yarn, textile or the like and defined as being thin and flexible fibers having a substantially longer length compared with the thickness. Typically, a long continuous fiber is defined as a filament and a short fiber as a staple. The proximal ends of the fibers of the fiber assembly 111*b* are bonded at the fusion bonded parts 113 and 114. The fibers of the fiber assembly 111*b* each have one end fixed at the fusion bonded parts and the other free end (distal end) on the opposite side. The fibers of the fiber assembly 111*b* extend in a direction transverse to the longitudinal direction of the cleaning element 110 (or the fiber assembly 111*b*). The fiber assembly 111*b* is also referred to as the "fiber bundle" having a plurality of fibers in a bundle.

In the representative example shown in FIG. 9, the fiber assembly 111*b* comprises three fiber layers, but it may comprise one or more fiber layers as necessary. Preferably, the fiber assembly 111*b* has a planar structure having a predetermined flat or curved region and has a three-dimensional form having a certain thickness or has a thin sheet-like form. The "fiber assembly" is typically formed of polyethylene (PE), polypropylene (PP), polyethylene terephthalate (PET), nylon, rayon or the like. In practical use, an assembly of filaments formed by opening a tow is frequently used as the fiber assembly. It is particularly preferable that the fiber assembly comprises conjugated fibers having a core of polypropylene (PP) or polyethylene terephthalate (PET) and a core covering sheath of polyethylene (PE). Further, the filaments of the fiber assembly are preferred to have a fineness of 1 to 50 dtex, more preferably 2 to 10 dtex. The individual fiber assembly may contain fibers of substantially the same fineness or of different finenesses.

Further, in order to enhance the dust wiping function, it is preferred to use a fiber assembly including fibers having higher rigidity or fibers having higher fineness. It is further preferred that the fiber assembly has crimped fibers. Here, the crimped fibers are fibers subjected to a predetermined crimping process and easily intertwined with each other. With the fibers being crimped, the fiber assembly becomes bulkier than before the holder is attached thereto, and dust can be easily captured by the crimped portions. This structure can be realized especially by using crimped fibers opened from a tow.

For the fiber assembly, fiat yarns or split yarns may also be used. The fiat yarns are prepared by slitting a film into tapes and by stretching the tapes in the longitudinal direction. The split yarns are prepared by splitting a thermoplastic film resin in the direction perpendicular to the orientation direction of the resin so that the film is fibrillated and interconnected into a net shape. Alternatively, a nonwoven fabric which is bulky and has low fiber density, such as a through-air bonded nonwoven fabric, may be used to form the fiber assembly.

The kinds and numbers of the component parts of the cleaning element 110 are not limited to those described in the above-described example, and can be selected as necessary.

(Other Embodiments)

The invention is not limited to the embodiment as described above, but rather, may be added to, changed, replaced with alternatives or otherwise modified. For example, the following provisions can be made in application of this embodiment.

In the above embodiment, the inclined part 136 is described as being configured to gradually increase in height and width from the tip end side toward the connection side of the holding plate 132. In this invention, however, it is essential that an area corresponding to the inclined part 136 gradually increases at least in height from the tip end side toward the connection side. In this construction, as for the structure of connecting the holder body-side connection 131 and the handle body-side connection 142, as described in the above embodiment, the insertion part 142*a* may be inserted into the demarcated region 131*d* of the holder body-side connection 131 and thus supported from three directions. Furthermore, the holder body-side connection 131 and the handle body-side connection 142 may be locked in the connected slate by engagement of the engagement protrusion 138 and the engagement hole 143 which are formed on the opposed sides of the bottom plate part 131*a* and the insertion part 142*a*. The connecting structure is not limited to this, but other connecting structures can be appropriately used.

Further, in the above embodiment, the holding plate 132 is described as having the inclined part 136, but, in this invention, an area corresponding to the inclined part 136 can form the entirety or part of the holding plate 132. For example, the inclined part 136 itself may form the entirety of the holding plate 132.

Further, in the above embodiment, the holder body 130 and the handle 140 are described as being separately formed. The invention can also be applied to a cleaning element holder in which a holding element corresponding to the holder body 130 and a grip corresponding to the handle 140 are formed in one piece.

Further, in the above embodiment, the cleaning element 110 is described as being formed by the sheet-type nonwoven fabric and the fiber assembly. In this invention, however, the cleaning element may be formed by either the sheet-type nonwoven fabric or the fiber assembly.

Further, in the above-embodiment, the cleaning element holder 120 is described as having two holding plates 132, but, the number of members corresponding to the holding plates 132 can be appropriately changed as necessary. For example, the invention can also be applied to a cleaning element holder having one or three or more holding elements.

DESCRIPTION OF NUMERALS

Figure 1:
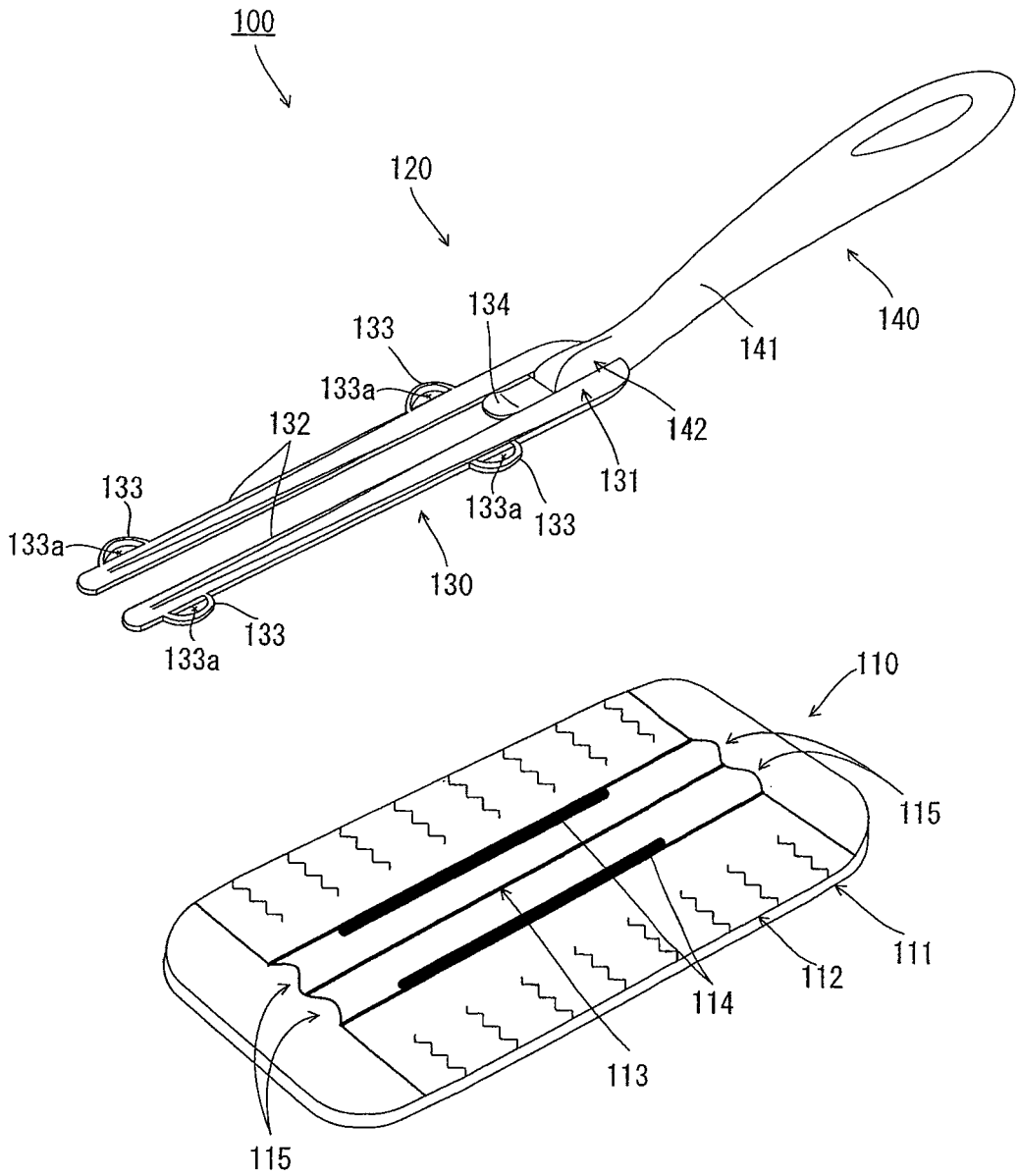
FIG. 1 is a perspective view showing a cleaning tool 100 according to an embodiment of the invention, in a disassembled state into a cleaning element 110 and a cleaning element holder 120.
Figure 2:
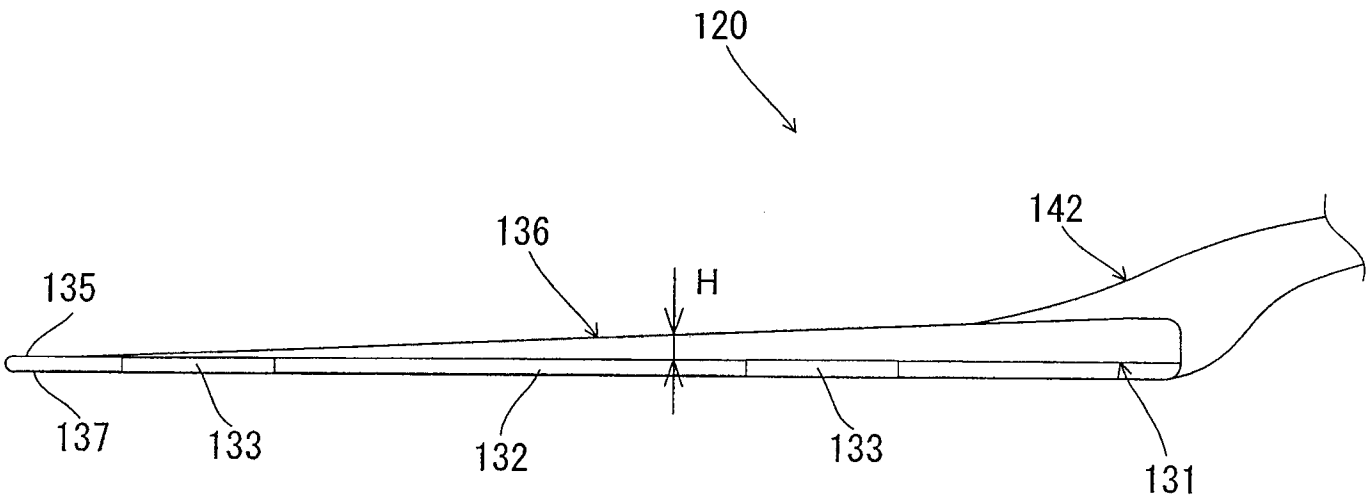
FIG. 2 is a side view of a holding plate 132 of a holder body 130 in this embodiment.
Figure 3:
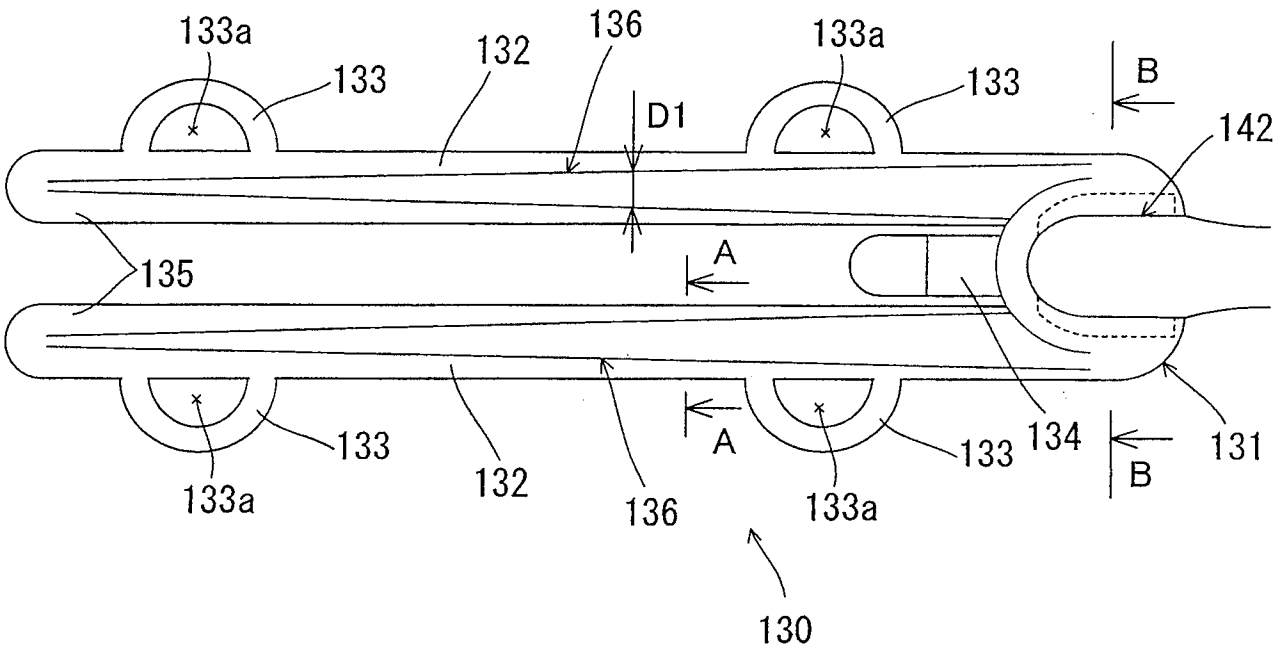
FIG. 3 is a plan view of the holder body 130 in this embodiment and its vicinity.
Figure 4:
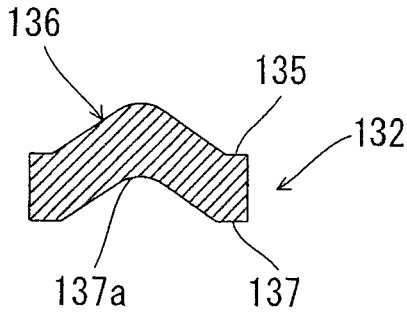
FIG. 4 is a sectional view of the holding plate 132 which is taken along line A-A in FIG. 3.
Figure 5:
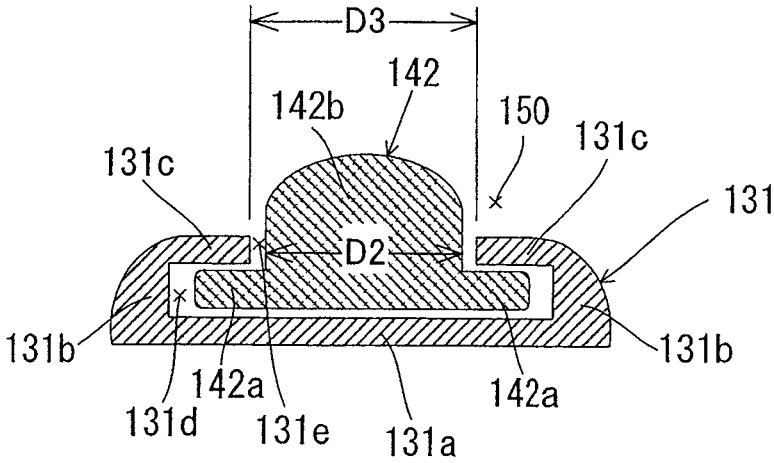
FIG. 5 is a sectional view of a holder body-side connection 131 and a handle body-side connection 142 which is taken along line B-B in FIG. 3.
Figure 6:
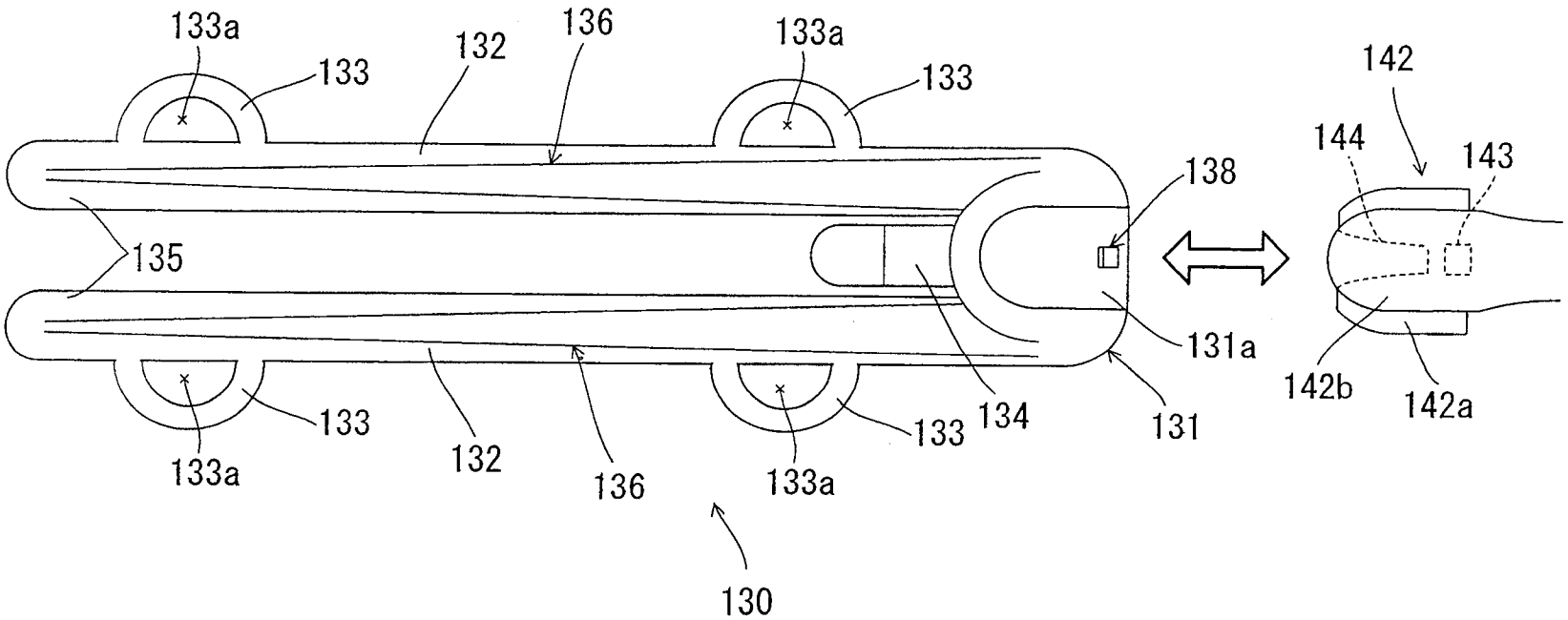
FIG. 6 is a plan view of the holder body 130 in this embodiment and its vicinity, showing the construction of the holder body-side connection 131 and the handle body-side connection 142.
Figure 7:
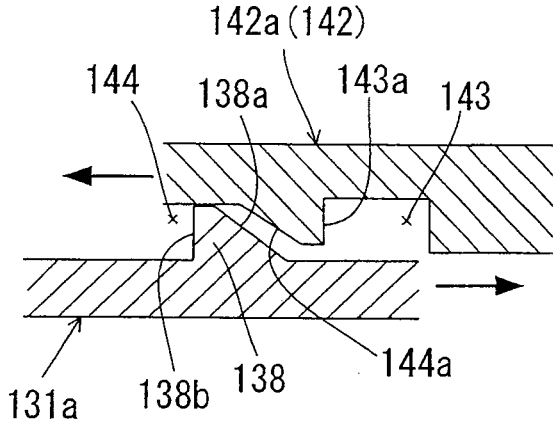
FIG. 7 is a sectional view showing the structure of engagement between an engagement protrusion 138 on the holder body-side connection 131 side and an engagement hole 143 on the handle body-side connection 142 side which are shown in FIG. 6, in a yet-to-be engaged state.
Figure 8:
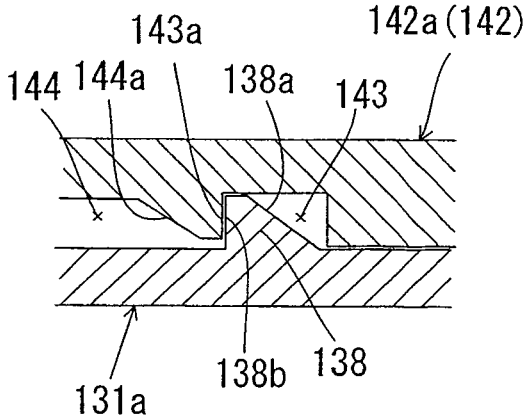
FIG. 8 is a sectional view showing the structure of engagement between the engagement protrusion 138 on the holder body-side connection 131 side and the engagement hole 143 on the handle body-side connection 142 side which are shown in FIG. 6, in an engaged state.
Figure 9:
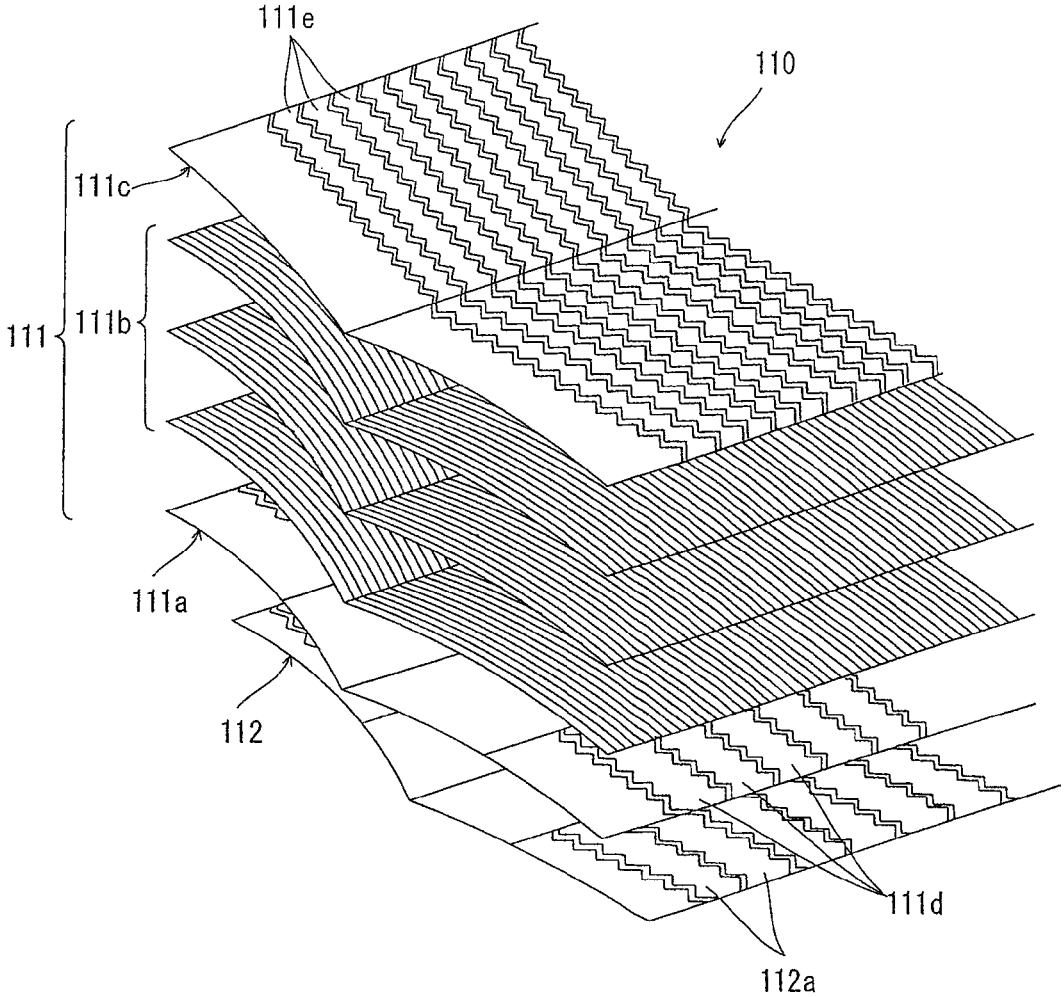
FIG. 9 is a perspective view of the cleaning element 110 of FIG. 1 which is shown separated into component elements.

100 cleaning tool
110 cleaning element
111 cleaning element body
111*a* base sheet
111*b* fiber assembly
111*c* cleaning side sheet
111*d*, 111*e* strip
112 holding sheet
112*a* strip
113, 114 fusion bonded part
115 insert region
120 cleaning element holder
130 holder body
131 holder body-side connection
131*a* bottom plate part
131*b* upright part
131*c* upper plate part
131*d* demarcated region
131*e* opening
132 holding plate
133 projection
133*a* hollow portion
134 retaining plate
135 holding plate upper surface
136 inclined part
137 holding plate lower surface
137*a* thin-walled part
138 engagement protrusion
138*a* engagement protrusion inclined part
138*b* engagement protrusion upright part
140 handle
141 handle body
142 handle body-side connection
142*a* insertion part
142*b* contiguous part
143 engagement hole
143*a* engagement hole upright part
144 guide hole
144*a* guide hole inclined part
150 upper region

The invention claimed is:

1. A cleaning tool for cleaning an object, said cleaning tool comprising:

an elongate cleaning element holder; and a cleaning element attachable to the cleaning element holder and having an insert region for receiving the cleaning element holder, wherein the cleaning element holder has a grip adapted to be held by a user, a connection part connected to the grip, and a pair of holding elements extending in a longitudinal direction from the connection part, the holding elements insertable into the insert region of the cleaning element to thereby hold the cleaning element, wherein each of the holding elements has an inclined part in which a height of the inclined part in a thickness direction transverse to the longitudinal direction gradually increases toward the connection part, each of the holding elements has upper and lower surfaces opposite to each other in the thickness direction, and both the upper and lower surfaces at the inclined part protrude upwardly in the thickness direction.

2. The cleaning tool as defined in claim 1, wherein the inclined part is contiguous to the connection part, and the height of the inclined part in the thickness direction peaks at an area of the inclined part which is contiguous to the connection part.

3. The cleaning tool as defined in claim 1, wherein each of the holding elements has a rigid part at a region close to the connection part and a flexible part provided at a region remote from the connection part.

4. The cleaning tool as defined in claim 1, wherein an entirety of the inclined part extends in the longitudinal direction of the corresponding holding element without extending beyond corresponding opposite edges of the holding element in the longitudinal direction.

5. The cleaning tool as defined in claim 1, wherein the height of the inclined part of each said holding element is increased in a linear form.

6. The cleaning tool as defined in claim 1, wherein the height of the inclined part of each said holding element is increased in a curved form.

7. The cleaning tool as defined in claim 1, wherein:

the grip and the pair of holding elements are separable from each other, and the connection part includes a first connection part on a side of the pair of holding elements and a second connection part on a side of the grip and engageable with the first connection part, as viewed in section in a transverse direction transverse to the longitudinal direction, the first connection part includes a bottom plate part extending along the holding elements, upright parts extending upward from both edges of the bottom plate part, respectively, an upper plate part extending between the upright parts above the bottom plate part, a demarcated region demarcated by the bottom plate part, the upright parts and the upper plate part, and an opening that is formed in the upper plate part and provides communication between the demarcated region and an upper region above the upper plate part, and the second connection part includes an insertion part which is insertable and engageable in the demarcated region, and a contiguous part that is contiguously formed on an upper side of the insertion part and has a smaller width than an opening width of the opening, and in the state in which the insertion part is inserted and engaged in the demarcated region, the contiguous part is exposed to the upper region through the opening.

8. The cleaning tool as defined in claim 7, wherein the connection part further comprises an engagement protrusion on one of opposed sides of the bottom plate part and the insertion part, and an engagement hole on the other side, and the grip and the pair of holding elements are configured to be locked with respect to each other by engagement of the engagement protrusion and the engagement hole.

9. The cleaning tool as defined in claim 1, wherein the pair of holding elements extends from the connection part in parallel in the longitudinal direction.

10. An elongate cleaning element holder for a cleaning element used for cleaning an object, said cleaning element holder comprising:

a grip adapted to be held by a user;

a connection part connected to the grip; and a pair of holding elements each extending in a longitudinal direction from the connection part, wherein the pair of holding elements is adapted to be inserted into an insert region of the cleaning element to thereby hold the cleaning element, each of the holding elements has an inclined part which is inclined such that a height of the inclined part in a thickness direction transverse to the longitudinal direction gradually increases toward the connection part, each of the holding elements has upper and lower surfaces opposite to each other in the thickness direction, and both the upper and lower surfaces at the inclined part protrude upwardly in the thickness direction.

11. The cleaning element holder as defined in claim 10, wherein the inclined part is contiguous to the connection part, and the height of the inclined part in the thickness direction peaks at an area of the inclined part which is contiguous to the connection part.

12. The cleaning element holder as defined in claim 10, wherein each of the holding elements has a rigid part at a region close to the connection part and a flexible part provided at a region remote from the connection part.

13. The cleaning element holder as defined in claim 10, wherein an entirety of the inclined part extends in the longitudinal direction of the corresponding holding element without extending beyond corresponding opposite edges of the holding element in the longitudinal direction.

14. The cleaning element holder as defined in claim 10, wherein the height of the inclined part of each said holding element is increased in a linear form.

15. The cleaning element holder as defined in claim 10, wherein the height of the inclined part of each said holding element is increased in a curved form.

16. The cleaning element holder as defined in claim 10, wherein:

the grip and the pair of holding elements are separable from each other, and the connection part includes a first connection part on a side of the pair of holding elements and a second connection part on a side of the grip and engageable with the first connection part, as viewed in section in a transverse direction transverse to the longitudinal direction, the first connection part includes a bottom plate part extending along the holding element, upright parts extending upward from both edges of the bottom plate part, respectively an upper plate part extending between the upright parts above the bottom plate part, a demarcated region demarcated by the bottom plate part, the upright parts and the upper plate part, and an opening that is formed in the upper plate part and provides communication between the demarcated region and an upper region above the upper plate part, and the second connection part includes an insertion part which is insertable and engageable in the demarcated region, and a contiguous part that is contiguously formed on an upper side of the insertion part and has a smaller width than an opening width of the opening, and in the state in which the insertion part is inserted and engaged in the demarcated region, the contiguous part is exposed to the upper region through the opening.

17. The cleaning element holder as defined in claim 16, wherein the connection part comprises an engagement protrusion on one of opposed sides of the bottom plate part and the insertion part, and an engagement hole on the other side, and the grip and the pair of holding elements are configured to be locked with respect to each other by engagement of the engagement protrusion and the engagement hole.

18. The cleaning element holder as defined in claim 10, wherein the pair of holding elements extends from the connection part in parallel in the longitudinal direction.

19. The cleaning tool as defined in claim 1, further comprising at least one projection projecting outwardly from each of the holding elements in a transverse direction perpendicular to the longitudinal direction.

20. The cleaning tool as defined in claim 8, wherein the engagement protrusion protrudes upwardly in the thickness direction from the bottom plate part toward the insertion part.

* * * * *